US010772386B2

(12) United States Patent
Carlucci et al.

(10) Patent No.: US 10,772,386 B2
(45) Date of Patent: Sep. 15, 2020

(54) SYSTEM AND A METHOD FOR CONTROLLING A SHOE PART PRODUCTION MACHINE

(71) Applicant: ECCO Sko A/S, Bredebro (DK)

(72) Inventors: Patrizio Carlucci, Bredebro (DK); Joseph Henry Mitchell, Sawbridgeworth (GB)

(73) Assignee: ECCO Sko A/S, Bredebro (DK)

( * ) Notice: Subject to any disclaimer, the term of this patent is extended or adjusted under 35 U.S.C. 154(b) by 0 days.

(21) Appl. No.: 16/078,945

(22) PCT Filed: Feb. 24, 2017

(86) PCT No.: PCT/EP2017/054331
§ 371 (c)(1),
(2) Date: Aug. 22, 2018

(87) PCT Pub. No.: WO2017/144663
PCT Pub. Date: Aug. 31, 2017

(65) Prior Publication Data

US 2019/0037971 A1 Feb. 7, 2019

(30) Foreign Application Priority Data

Feb. 24, 2016 (EP) ..... 16157130

(51) Int. Cl.
*A43D 1/02* (2006.01)
*A43B 7/14* (2006.01)
*A43D 119/00* (2006.01)

(52) U.S. Cl.
CPC ..... *A43D 1/02* (2013.01); *A43B 7/1455* (2013.01); *A43D 119/00* (2013.01); *A43D 2200/00* (2013.01)

(58) Field of Classification Search
CPC ..... A43D 1/02; A43D 119/00; A43D 1/022; A43D 2200/00; A43B 17/00; A43B 7/1455
(Continued)

(56) References Cited

U.S. PATENT DOCUMENTS 4,538,353 A * 9/1985 Gardner ..... A43D 1/025 33/3 B
4,604,807 A * 8/1986 Bock ..... G01B 11/024 33/3 B
(Continued)

FOREIGN PATENT DOCUMENTS

WO WO 91/17677 A1 11/1991
WO WO 02/061655 A1 8/2002
(Continued)

OTHER PUBLICATIONS

International Search Report and Written Opinion dated May 12, 2017, in International Application No. PCT/EP2017/054331 (9 pgs.).

*Primary Examiner* — Yaritza Guadalupe-McCall
(74) *Attorney, Agent, or Firm* — Finnegan, Henderson, Farabow, Garrett & Dunner, L.L.P.

(57) ABSTRACT

The present invention relates to a method for generating control data for controlling a shoe part production machine for making shoes or elements for optimizing traction properties of the shoe by customizing modules to be mounted on the sole for a specific user, said method comprising the steps of: receiving user profile data describing the characteristics of the user where the user profile data comprise use data and test data, receiving a user selection identifying a selected shoe from a number of shoe models or a selected element influencing the property of a shoe, generating modified template data by modifying a shoe sole template corresponding to the selected shoe model or by modifying an element
(Continued)

influencing the properties corresponding to the selected element, said modifications being performed based on said received user profile data, generating control data based on said modified template data.

20 Claims, 5 Drawing Sheets

(58) Field of Classification Search
USPC ..... 33/3 B
See application file for complete search history.

(56) References Cited

U.S. PATENT DOCUMENTS 5,025,476 A * 6/1991 Gould ..... A61B 5/1074 382/115
5,206,804 A * 4/1993 Thies ..... A43D 119/00 705/26.7
5,216,594 A * 6/1993 White ..... A43D 1/025 705/28
6,463,351 B1 * 10/2002 Clynch ..... A61F 2/5046 623/901
7,743,530 B2 * 6/2010 Truelsen ..... B29D 35/062 12/142 T
9,854,867 B2 * 1/2018 Bier ..... A43B 7/088
10,140,392 B1 * 11/2018 Bowen ..... G06F 3/0482
10,282,914 B1 * 5/2019 Tran ..... A61B 5/6829
10,327,502 B2 * 6/2019 Schouwenburg ..... A61F 5/14
2002/0158358 A1 * 10/2002 Franzene ..... A43D 1/025 264/40.1
2004/0168329 A1 * 9/2004 Ishimaru ..... A43D 1/02 33/3 R
2005/0071242 A1 * 3/2005 Allen ..... G06Q 10/087 705/26.5
2006/0247892 A1 * 11/2006 Peterson ..... A43D 1/02 702/167
2006/0283243 A1 * 12/2006 Peterson ..... A61B 5/1036 73/172
2007/0163147 A1 7/2007 Cavanagh et al.
2008/0189194 A1 * 8/2008 Bentvelzen ..... A43B 3/24 705/26.5
2009/0076772 A1 3/2009 Hinshaw et al.
2009/0208113 A1 * 8/2009 Bar ..... A43D 1/022 382/199
2009/0254207 A1 * 10/2009 Tiffany ..... A43B 1/0054 700/97
2010/0318442 A1 * 12/2010 Paul ..... G06Q 30/06 705/26.5
2011/0004524 A1 * 1/2011 Paul ..... G06Q 30/02 705/14.58
2011/0099122 A1 * 4/2011 Bright ..... G06Q 10/04 705/348
2014/0012406 A1 * 1/2014 Cioffi ..... A43B 23/24 700/118
2015/0081076 A1 * 3/2015 Fernandes ..... G06F 17/50 700/98
2015/0101134 A1 * 4/2015 Manz ..... A43D 119/00 12/142 R
2016/0066655 A1 * 3/2016 Goldie ..... A43D 1/025 700/97
2017/0068774 A1 * 3/2017 Cluckers ..... A61B 5/743
2017/0228859 A1 * 8/2017 Schouwenburg .... A43B 7/1485
2017/0308945 A1 * 10/2017 Loveder ..... G06Q 30/0621
2018/0247426 A1 * 8/2018 Gluck ..... G06Q 30/00
2018/0253079 A1 * 9/2018 McInnis ..... B33Y 50/00
2018/0300791 A1 * 10/2018 Ganesan ..... G06Q 30/0601
2019/0037971 A1 * 2/2019 Carlucci ..... A43D 1/02
2019/0175070 A1 * 6/2019 Decker ..... G06Q 30/0621
2019/0232592 A1 * 8/2019 Tran ..... A43B 3/0005
2019/0297995 A1 * 10/2019 Loveder ..... A43B 13/12

FOREIGN PATENT DOCUMENTS

WO WO 2008/070537 A2 6/2008
WO WO 2008/080137 A1 7/2008
WO WO 2014/100462 A1 6/2014
WO WO 2015/169941 A1 11/2015

* cited by examiner fig 4.1 fig 4.2 fig 4.3 fig 4.4 fig 5.1 fig 5.2 fig 5.3

SYSTEM AND A METHOD FOR CONTROLLING A SHOE PART PRODUCTION MACHINE

CLAIM FOR PRIORITY

This application is a U.S. national phase entry under 35 U.S.C. § 371 from PCT International Application No. PCT/E P2017/054331, filed Feb. 24, 2017, which claims the benefit of priority of EP Application No. 16157130.2, filed Feb. 24, 2016, from both of which this application claims priority and both of which are incorporated herein by reference.

The present invention relates to a method for generating control data for controlling a shoe part production machine for making shoes or elements for influencing the properties of the shoe, such as inlays or modules to be mounted on the sole.

BACKGROUND OF THE INVENTION

Comfort of shoes can be crucial to the persons wearing them, both in respect of the persons' general well-being, where shoes are worn often every day and for many hours, but also in connection with the performance of a person when using the shoes.

Typically, shoes are being made in series having different kinds of properties, where one shoe series has a sole with a specific flexibility and another shoe series has another flexibility. The properties of each series are then determined based on different tests being made on models of a shoe and based on feedback from users of prior series.

All users have feet, which are uniquely shaped, and similarly, the dynamics of a foot is unique—for this reason, it will be impossible or at least difficult for a user to find a shoe, which has the optimal properties. Since the user will have to choose between series of produced shoes, the user will have to compromise and find the best shoe series available—not the optimal shoe.

Furthermore, making specific measurements at the shoe store by looking at the feet of the user, making a short usage test (e.g. on a running belt or similar) and further by looking at the wear characteristics of the older pair of shoes is typically the full extent of identifying the best shoe for the user.

A further problem by having series of shoes is that both shoes in a pair of shoes are made having similar properties being basically mirrored to fit respectively a left and a right foot, but when it comes to the feet of a user then the dynamics and shape can be quite different, whereby the shoes in a pair of shoes will be more suitable to one foot than the other.

SUMMARY OF THE INVENTION

Therefore, it is an object of the present invention to solve the above-mentioned problems.

This is obtained by a method for generating control data for controlling a shoe part production machine for making shoes or elements for optimizing traction properties of the shoe by customizing modules to be mounted on the sole for a specific user, said method comprising the steps of: receiving user profile data describing the characteristics of the user where the user profile data comprise use data and test data, receiving a user selection identifying a selected shoe from a number of shoe models or a selected element influencing the property of a shoe, generating modified template data by modifying a shoe sole template corresponding to the selected shoe model or by modifying an element influencing the properties corresponding to the selected element, said modifications being performed based on said received user profile data, generating control data based on said modified template data.

Thereby, user specific parameters are combined with the parameters to be used for producing a shoe based on specific shoe design templates and a predesigned shoe can be optimised for the user, ensuring comfort for the user wearing the shoe. This is all done by receiving user specific data e.g. by measuring or analysing the user to create user profile data and then use this user profile data to amend the shoe design template in relation to its comfort elements, such as the sole and/or inner support of the shoe. Thereby, shoes from a specific design collection can still be modified to be optimised to the actual comfort needs and properties of the user. The template data could be in a non-limiting manner to fit the exact needs of the user or the data may alternatively be optimised within a limit determined by the limitations of the shoe design.

The data captured from individual users may be gathered centrally, affording an overview of shoe use and shoe wear patterns among a number of users, such as thousands of users or more. In this manner, the gathering of data for specific sole-design allows the production of yet better soles even for those not immediately using shoes produced according to the invention. For example, a number of global use patterns may emerge, where global means among substantially all users of shoes produced according to the invention. Each use pattern may represent a user group, where at least some of the groups may not today be able to get good shoes, or where some groups are underrepresented among produced shoes, or where users may not easily identify their own group.

The method may be adapted to design a shoe for a user, where the traction properties of the shoes have been customized for the specific user, a the user data may comprise data that identifies of the users movements, stance and gait may affect the traction on e.g. a standardized model of a shoe, and how the users movements are transferred via the ground contacting surface of the shoe and the shoe. Thus the user profile data can identify the specific characteristics of the user's movements, and identify how the ground contacting surface of the shoe is stable, unstable in predetermined factors.

I.e. the user profile data may identify how the user applies force to the ground, and identify how the users movements affect the traction of the shoe, by specific measurements on e.g. how the shoe slips during the movement.

By identifying how the movement of the user is related to the specific type of shoe model and/or traction elements on the shoe, it may be possible to change the traction elements to suit the user specifically, so that specific areas of the shoe may be modified to improve traction, reduce traction, or maintain the same traction. Furthermore, the shoe may further be modified differently in different areas of the shoe, such as in the heel area, arch area, forefoot area, medial side or the lateral side, and the ground contacting surface of the shoe may be divided into a number of different areas, that may be individually adjusted to customise the sole of the shoe for the user.

Alternatively or additionally, the shoe may be altered by changing the insole of the shoe, the midsole of the shoe, or differently, in order to obtain the optimal ground contacting surface for the specific foot, gait, or stance of the user.

In an embodiment, the template data stored in said storage means is linked to a predefined number of possible modified templates and one of said modified templates is selected based on said modified template data. Thereby, a limited number of alterations are possible due to restrictions by the manufacturing machinery, the design, etc. and still the template best suitable for the comfort of the user can be chosen.

In an embodiment, said user profile data comprises user data and test data, use data describing data relating to usage of another shoe or maybe a similar shoe, such as on which surface, where the shoe used, which temperature did the foot have while wearing the shoe, how did the user support the foot, etc. All this is very powerful data to use, when an optimal shoe is needed.

In one embodiment the user data comprises data on actual use of shoes by the user. Within the meaning of the present invention, the actual use of the shoes may mean that the user may wear a shoe for a predetermined period, where the user may use the shoe during the predetermined period for a specific activity, such as hiking, playing golf, walking on specific surfaces and other manner, and where the user data represent actual measurements of the user using a shoe in a specific activity, and the modification of the shoe may be applied to the shoe to represent this specific activity. As an example, a user may borrow a specific model of a golf shoe, having specific properties that have previously been chosen for this user, where the shoe is fitted with a sensor in the sole of the shoe. The user goes to a golf course, and plays a predetermined number of shots, and/or a predetermined number of different types of shots, where the sensor registers predetermined parameters during the use, in order to identify how the shoe reacts with the ground during a golf swing, on a certain type of surface.

Thus, during use, the user may show a certain type of slippage through the golf swing, where the sensor can measure in what way the shoe has moved during the swing, and possibly in what direction.

Knowing the type of sole, the actual usage data may be utilized to modify the sole of the shoe, so that the specific amount of unwanted slippage may be reduced, and thereby improving the traction of the golf shoe for this specific user. As golf swings and stances vary significantly from one golfer to another, it may be difficult to provide all golfers with a specific sole design, that suits all golfers. Thus, by measuring the usage data of a specific golfer, the golf shoe may be customized for this golfer, so that the golfer obtains the optimal traction, while still maintaining a good comfort and maintaining shoes that are allowed on a golf course.

In an embodiment, at least some of said user data describes the shoe usage pattern of the user, which has been automatically stored and collected by a data collection unit positioned on the shoe. This is a very easy way to ensure a constant measurement of data during everyday use of the shoe.

In an embodiment, at least some of said user data comprises data obtained by questioning the user. This data can easily be obtained without any further measurements and may include factual data such as weight, height, feeling of comfort when using shoe, etc.

In an embodiment, at least some of said test data is obtained by testing the user, e.g. in a walking machine or a foot pattern measurement device. Thereby, data can be obtained that cannot be obtained by questioning, such as walking style, running style.

In an embodiment, a shoe sole template to be modified describes a shoe sole having cleats and wherein at least the positioning and/or design of said cleats are modified according to said user profile data. Cleats are influencing the comfort when wearing a shoe, also in relation to golf shoes. Therefore, it is of high relevance to be able to optimize the cleat structure, positioning according to the user.

In an embodiment, a shoe sole template to be modified describes a shoe sole having integrated support areas and wherein at least the positioning and/or design of said support areas is modified according to said user profile data. Again, the inner support needed in a shoe can be quite individual, but also decisive when it comes to the comfort when wearing a shoe.

In an embodiment, an element for influencing the properties of a shoe is a cleat element to be attached to a shoe sole surface and wherein at least the positioning and/or design of said cleats on said cleat element is modified according to said user profile data. Thereby, the entire shoe can be prefabricated and only the cleat elements are made user specific. The cleat elements are then to be attached to the sole surface via an attachment system, e.g. screw or a snap system for easy replacement.

In an embodiment, an element for influencing the properties of a shoe is a support element to be positioned inside the shoe and wherein at least the design of said support element is modified according to said user profile data.

In an embodiment, generating modified template data is based on a combination of said user profile data and pre-collected user data to improve the calculation algorithms of said system for situations where substantially only test data is available. Thereby, also older collected data The present invention further relates a system for generating control data for controlling a shoe part production machine for making shoes or elements for influencing the properties of the shoe, such as inlays or modules to be mounted on the sole.

In one embodiment the collected data originates from measurements performed in the heel area of the shoe. The collected data may be recorded from the shoe sole during use, where the collection unit may be arranged in the heel area of the shoe. The collection unit may be removeably fixed in the sole of the shoe, where the position of the unit is fixed, so that all movements of the sole may be registered by the data collection unit, via a number of different types of measurement elements, such as accelerometers, gyroscopes, pressure sensors and so on. Thus, when movement is applied to the shoe, the same movement is applied to the measurement unit, and where the position of the measurement unit relative to the shoe does not change. As an example, when the shoe may slip, the measurement unit or collection unit will move in space a in a similar manner to the slip, and the slip may then be measured using e.g. an accelerometer. Alternatively, when the shoe is moved a certain amount in space, a gyroscopic sensor would be able to register the change in tilt of the shoe in space, and register the angle of the shoe.

In one embodiment the user data comprises measurements from at least two different types of measurement data which are compared to identify a data collection period for identifying modification data. Thus, by utilizing more than one type of data, it would be possible to identify a specific time period, where the collected data shows a specific movement, or behavior of the shoe, and the data that is present in the specific time window may be utilized to identify a specific behavior of the shoe during that time period. E.g. during gait, the measurement data from a gyroscope could be used to identify when the shoe is in contact with the ground, based on the position of the shoe, while a pressure sensor and/or a accelerometer can identify other types of data, such as the magnitude of impact, or any loss in traction due to slippage that may be registered by the accelerometer.

In one embodiment the user data comprises actual measurements of pressure and acceleration collected during use by a data collection unit positioned in the shoe. By obtaining measurements of pressure and acceleration in a data collection unit positioned in the shoe, it is possible to identify a moment of impact of the shoe with the ground during gait, stance or through a golf swing. The pressure measurement can identify the moment where a difference in pressure is applied to the measurement unit, which may represent a heel strike, a weight shift of the stance during a golf swing, where the acceleration measurement can identify how the shoe moves in the preceding or subsequent moments to the pressure difference. By doing this it is possible to identify the moment where traction is needed, and measure how the shoe reacts during that moment, whether it slips, and possibly the direction of movement. Furthermore, a compass measurement element may be applied to the data collection unit, in order to identify the orientation of the shoe during measurement.

In one embodiment the acceleration measurements are collected in at least one dimension that is substantially parallel to the ground contacting surface of the shoe. The acceleration measurements may be utilized to identify how the shoe may move in relation to a ground surface, where the acceleration of the shoe in a dimension parallel to the ground contacting surface may register whether the shoe moves forwards, backwards, or sideways in relation to the ground contacting surface, when the shoe is in contact. The measurement may also be provided in two dimensions, so that the data collecting unit may collect data in an x and y axis, which may e.g. be perpendicular to each other, and the data collected will then represent slippage or movement in a plane that is parallel to the ground contacting surface, where the x axis may represent the longitudinal direction of the shoe, while the y axis may represent the transverse direction of the shoe, or vice versa. Alternatively, the directions may be in any direction, provided that the data collected is not identical in both axes, i.e. measuring acceleration in the same direction.

In one embodiment the pressure measurements are collected in a dimension which is at an angle to the ground contacting surface of the shoe. The pressure sensor may be utilized to measure the force applied by the foot of the wearer on the sole, so that when the shoe is positioned on the ground, any change in weight applied by the wearer may be measured. The pressure sensor may measure data when force is applied in a direction that is at an angle to the ground contacting surface, i.e. where the angle is not parallel to the ground. One such angle may e.g. be perpendicular to the ground contacting surface, or anywhere between a 1 or 90 degree angle to the ground contacting surface.

Thus the pressure sensor will register the weight of the foot applied to the sole of the shoe when the shoe is in contact with the ground.

The invention further relates to a shoe sole and a shoe comprising a system according to the above.

BRIEF DESCRIPTION OF THE DRAWINGS

In the following, the invention will be described in detail with reference to embodiments shown by the enclosed figures. It should be emphasized that the embodiments shown are used for example purposes only and should not be used to limit the scope of the invention.

The following figures are used to describe embodiments of the present invention, wherein.

BRIEF DESCRIPTION OF THE DRAWINGS

Figure 1:
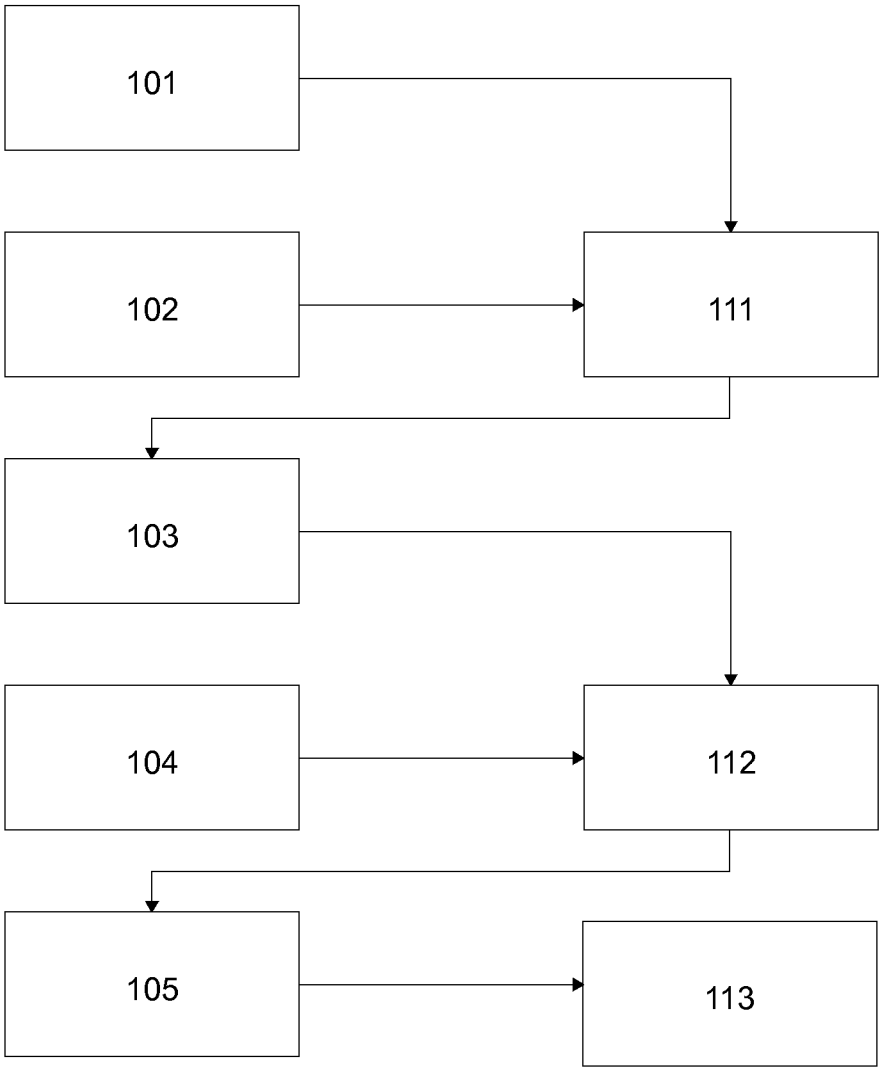
FIG. 1 illustrates a flow diagram of the method and the functionality of a system according to the present invention.

FIG. 1 illustrates a method according to the present invention. User data 101 and/or test data 102 is collected from a user, typically as part of a purchase of a new shoe, where in a preferred embodiment, detailed data of the previous use patterns of the user is available in the form of user data 101. The data is collected as user profile data 103. The user selects one or more preferred shoe models, and the user profile data is then accessed and combined with template data 104 for the respective shoe models, generating modified template data 105. This modified template data is essentially a blueprint of a finished shoe or sole of a shoe, with a sole geometry specifically fitted to the individual needs of the user, such as with extra stiffness, cushioning or flexibility in specific regions of the shoe. In another embodiment of the invention, the template data refers to sole inlays or modules mountable onto a shoe or sole instead of directly modifying the sole.

User data 101 is any data on the actual use of shoes by the user, and in a preferred embodiment, user data is obtained through a sensor unit inside or mounted on a previously worn shoe, allowing users to obtain shoes fitted to his/her wear and use patterns instead of projected or guessed needs. Test data 102 is any data collected with the aim of testing and/or assessing the special needs of a new pair of shoes by a user and is especially useful when detailed use data is unavailable or inadequate. The specific source of data used is unimportant, and may for example take the form of questionnaires, talking directly with the user as s/he is in the shoe shop as part of buying shoes, running or walking on a treadmill, or other useful and convenient simulations such as loaning a pair of shoes for prolonged wear or even pictures of feet or previously worn shoes. In a preferred embodiment, this data is digitalized and even stored centrally. This allows automatic processing, saving the user profile data for later use and to compare among users to further specialize sole designs. In one embodiment of the invention, this digitalization of test data allows identification of segments of user groups for more adapted later shoe and sole design, such as finding a need for a hybrid running and trekking shoe within one or more user segments.

Input data processing 111 is performed on inputted test and use data. The data could be analyzed to identify use patterns, which results in user profile data 103 for further processing. Raw data is interpreted as characteristics of the user, and in one embodiment of the invention, the data is normalized over different shoe types or takes account of the shoes on which the data was collected, this way achieving more precise user profile data. For example, the processing may take account of a both high-heeled shoes and a boot or compensate for data collected on running shoes and the new shoes for the user being dress shoes.

In one embodiment, previously collected user data 101 and test data 102 is computed to improve the ability of the system to recognize customer wear patterns e.g. by letting computations be adaptable over time through adaptive computing technologies such as machine learning. This allows future users precise sole design and sole design with limited test data, improving overall system shoe production performance. For example, if previous users who had worn out the shoe by the outside middle section of the shoe (i.e. the lateral support) turned out to pronate, a user without precise use data, but with pictures of shoes worn out by the lateral support would indicate pronation to this adaptive system.

Through input data processing, user profile data 103 is produced, which describes the specific usage style of the user according to a set of parameters. In one embodiment, user profile data comprises at least one parameter of wear patterns, extra stability needs, extra flexibility needs and at least one specified usage situation or any combination of these. These parameters may be differentiated for different regions of the foot as well as for different uses, so that one user profile data set may comprise a need for extra stability in the heel but extra flexibility in the footpad area.

Template data 104 exists for each shoe model, which is modifiable, based on user profile data. In one embodiment of the invention, this template data includes essentially a core design modifiable in a number of ways, where each modification has a number of predesigned configurations, and where each configuration is known to produce a specific effect in the final shoe. For example, one shoe model may have a template with a modifiable heel support, a modifiable lateral support, a modifiable arch support and a modifiable forefoot support (see FIG. 5), each of which can have a number of configurations such as 'high degree of support', 'normal degree of support', and 'low degree of support', this example producing 3*3*3*3=81 different sole geometries. In this embodiment, the expected effects in the final shoe corresponds to the user profile data in a way that allows an algorithm to select a configuration for each possible modification from this defined list to accommodate the specific needs of a user with predictable results, such as a high degree of heel support for some users, a medium amount for others and low or none for yet others.

In one embodiment of the invention, the various configurations of at least one modification has qualitatively different shapes such as cleats being either truncated screw-driver head shaped or flat, or even some other convenient shape.

In another aspect of the invention, template data may comprise modules or inlays for shoes, where user profile data corresponds to modifications in these, such as modules mountable on the sole (see FIG. 4) according to user profile data, these modules or soles supplying different qualities such as higher stiffness or higher flexibility compared to the core design.

In another embodiment of the invention, configurations are not made based on a numerable list of possibilities, but takes a shape as defined by a continuum of values within two accepted threshold values, such as a support being anything from 0 cm to 4 cm according to fine-grained use data.

In yet another embodiment, the sole is not modifiable in a numerable (or countable) number of ways and/or regions of the sole, but as a single element, where modifications may be chosen in a complex, interrelated way, where some modifications are important to each other and may preclude others. For example, a sole may be configurable for specific needs such as against pronation and the required geometrical changes to the core design are made not considering certain modification regions or types, but rather precisely for the needed purpose, making necessary changes based on the whole geometry at once. Such modifiability allows the fullest customization possible while maintaining the template and outer shoe appearance.

Based on customer data and template data, geometry calculations 112 are performed to identify modified template data 105. Calculations are made based on user needs and available configuration space to design a blueprint for the optimal shoe, achieving the optimal parameter values for said user from a wide range of template configurability. In one embodiment, the modified template data may be processed into a control data, depending on convenience.

Modified template data 105 or control data is fed to a production system for shoe construction 113, where it is used to steer the actual construction of the shoe.

In one embodiment of the invention, the shoe is constructed through 3D printing at a convenient location, such as near the shoe shop, or at a production plant. In another embodiment of the invention, the sole is produced according to conventional methods such as through injection moulding, the shape of the sole being modifiable, for example by switching out specific parts of the mould prior to moulding, or having a set of different moulds for each combination of configurations. In one embodiment of the invention, the sole has ready-made module-inserts and separately produced modules, these modules fitting into the inserts (see FIG. 4), the modifications made to the template being the choice of modules. This modification can take place in the shoe shop at purchase, where shoes can be sold with the appropriate sole modules directly as designated by user profile data. In another embodiment, the modifications to the shoe may take the form of sole inlays chosen specifically based on user profile data.

In one embodiment, a sensor is inserted into the sole of the shoe or mounted in the shoe during or after manufacture, which is adapted to collect information on use patterns, through sensing at least one of pressure, acceleration, direction of the shoe, humidity, orientation of the shoe, temperature, shear and compressive and tractive forces. The data gathered constitutes a useful source of use data 101 for further optimization of later shoes for a given user.

Figure 2:
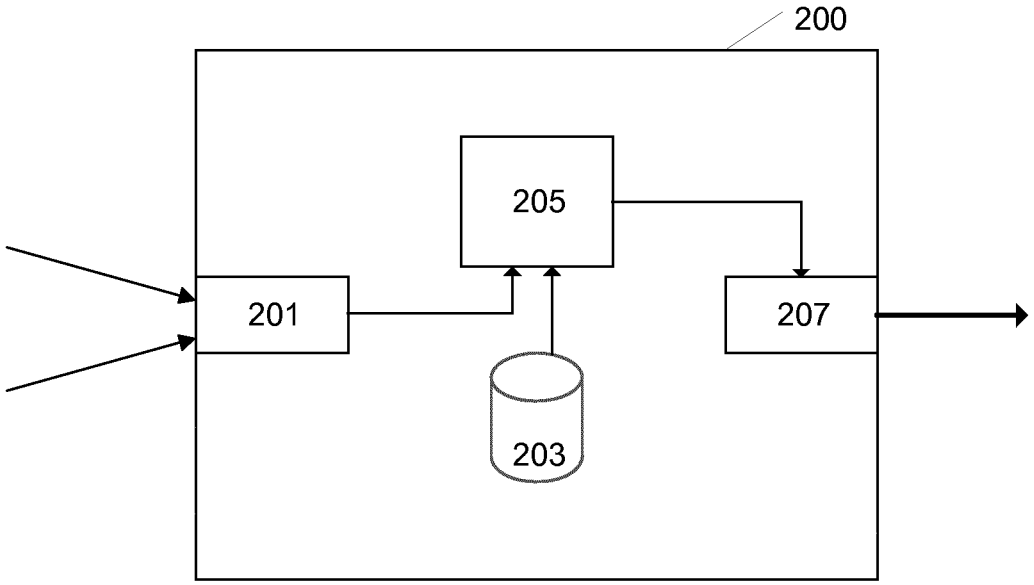
FIG. 2 illustrates the elements of a system according to the present invention.

FIG. 2 illustrates the elements of a system according to the present invention. The system 200 comprises input means 201 and this may e.g. be a receiver for receiving data from a data extraction device e.g. for extracting stored data on a data collection unit, such as a chip from a shoe. The input means could further be a touch screen, a keyboard or similar for providing data to a computer system. The input means are connected to a processing unit 205 such as a CPU for executing program code. The CPU are further connected to a data storage 203 and as an embodiment, the system further comprises output means such as a transmitter for communicating to another device e.g. a shoe part production machine.

The input means 201 are for receiving (see arrows) user profile data describing characteristics of the user and a user selection identifying a selected shoe from a number of shoe models or elements influencing the property of a shoe. The storage means store template data describing shoe soles relating to each of said shoe models or said template data describes other elements influencing the properties of the shoe. The processing unit generates modified template data by modifying a shoe sole template corresponding to the selected shoe model or by modifying an element influencing the properties corresponding to the selected element. The modifications are performed based on the received user profile data. Finally, the processing unit also generates control data based on said modified template data. Via the output means, these control data can then be sent to a shoe part production machine.

Figure 3:
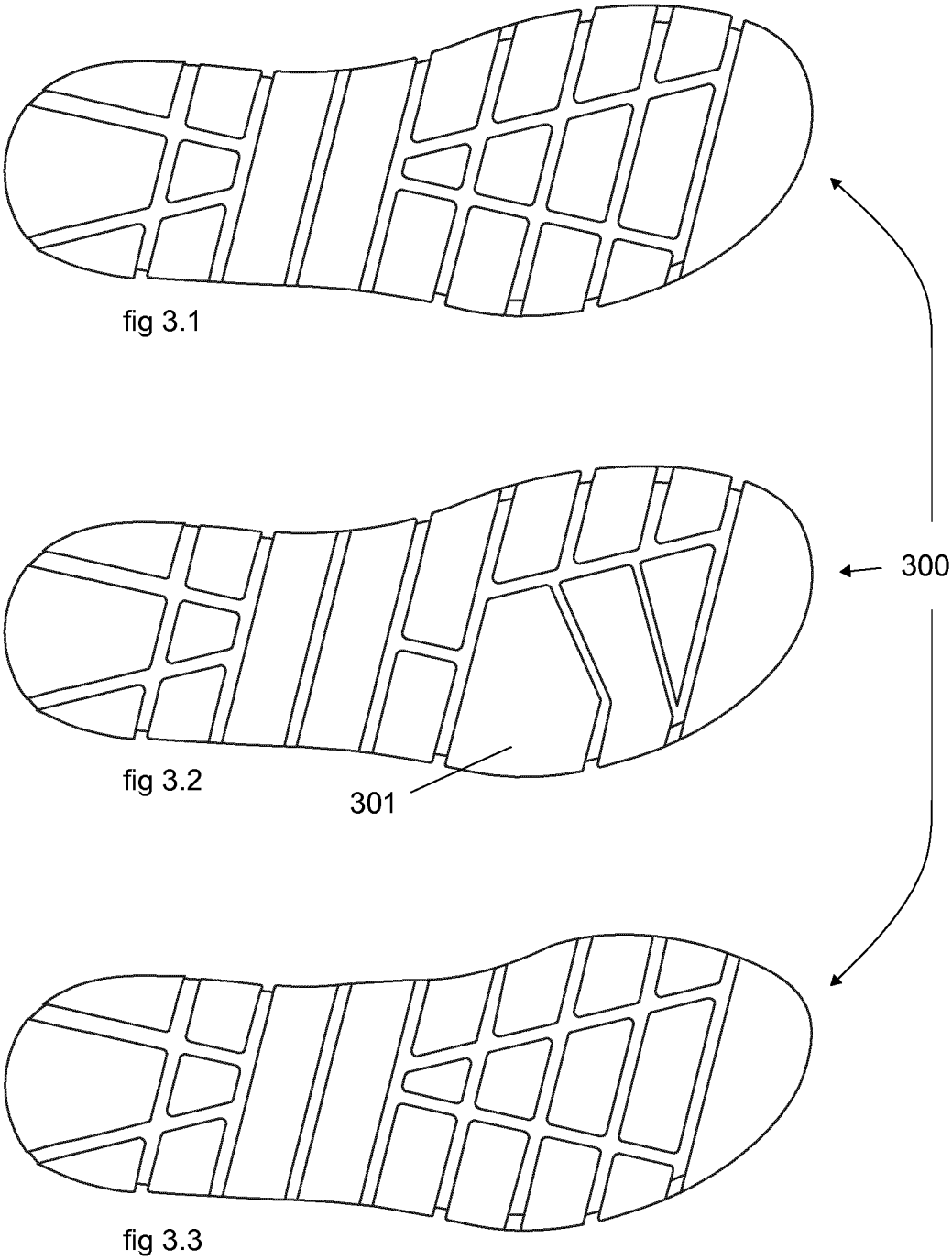
FIG. 3 illustrates one example of different sole surface structures based on the present invention.

FIG. 3 is a bottom view of three embodiments of a shoe (300) constructed according to the present invention. All being constructed according to the same initial template data and different user profile data, said shoes comprise a sole whose shape is configured specifically according to said user profile data. Said sole comprises a set of cleats covering the majority of the lower surface of said sole.

FIG. 3.1 illustrates a configuration of cleats on the footpad of the shoe, whose cleats are substantially rhombus-shaped. FIG. 3.2 illustrates a configuration of cleats on the forefront of said shoe, some of which are triangles and pentagons, and one of which has a size substantially larger than the rest (301), supplying a higher stiffness to the shoe in this region.

Based on usage patterns of a user, user profile data is created, which is used to modify a template shoe to supply the degree and placement of support the user needs, after which the sole is manufactured to these specifications, employing different cleat patterns to achieve a differentiated support.

Shoes may vary not only between users but also between a left and a right shoe for the same user. If a user has special needs for support or flexibility, for example in one foot, a sole can be specially designed for this. This may for example be the case for a user who has undergone surgery, a user with an injury, for example from sports, or in other situations where differentiated support is useful.

Figure 4:
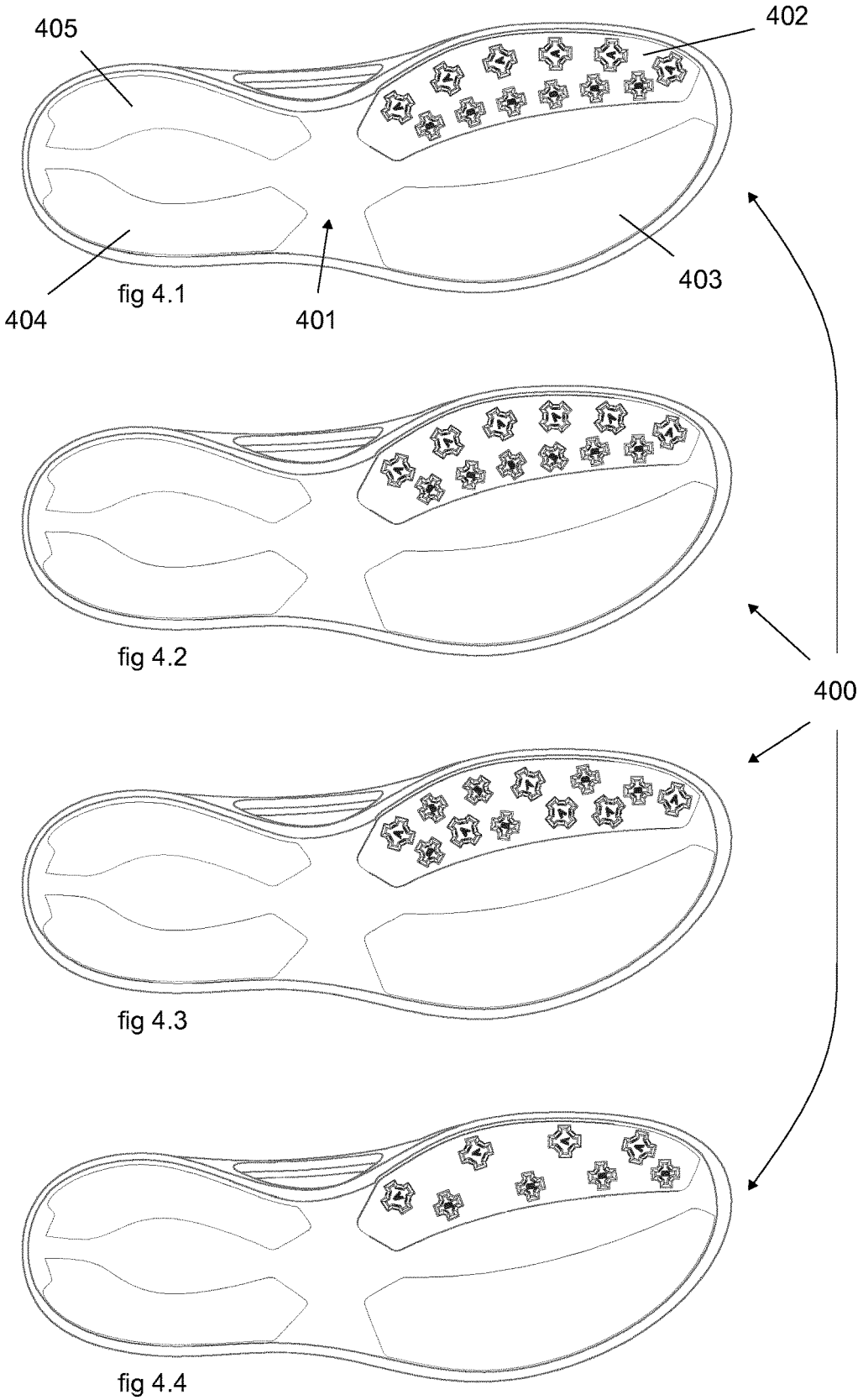
FIG. 4 illustrates different modules of cleat structures based on the present invention.

FIG. 4 is a bottom view of four embodiments of a shoe (400) constructed according to the present invention from the same initial template data and different user profile data, said shoes comprising a sole (401), which is configurable by the insertion of four modules chosen based on user profile data, where in FIG. 4, this configuration is limited to an inward footpad module (402) for readability purposes only—the three other module areas of the sole (403, 404 and 405) have the same features described for the inner footpad module (402).

Each embodiment as seen in FIGS. 4.1, 4.2, 4.3, and 4.4 comprises a unique configuration of cleats in said inner footpad module according to user profile data supplied for their construction, said configuration being for example position, arrangement, orientation, number and size of said cleats. Cleats are supplied in two sizes, cleats A and cleats B, where cleats A are larger than cleats B.

FIG. 4.1 depicts cleats A offset inwards from the outer edge in a line parallel to said outer edge and cleats B offset from the inner edge in another line parallel to the inner edge of said inner footpad module (405), oriented relative to the shoe, further characterized in that cleats A and cleats B are arranged parallel to these lines and are distributed evenly along it. FIG. 4.2 depicts a shoe otherwise similar to the shoe of FIG. 4.1, with the difference that cleats A and cleats B are oriented unorderly. FIG. 4.3 depicts a shoe otherwise similar to the shoe of FIG. 4.2, with the difference that cleats A and cleats B are positioned according to a different pattern than along substantially straight lines. FIG. 4.4 depicts a shoe otherwise similar to the shoe of FIG. 4.1, with the difference that said inward footpad module comprises fewer cleats.

As previously described, the left and right shoes do not need to mirror one another, but may be individually designed for each foot.

Figure 5:
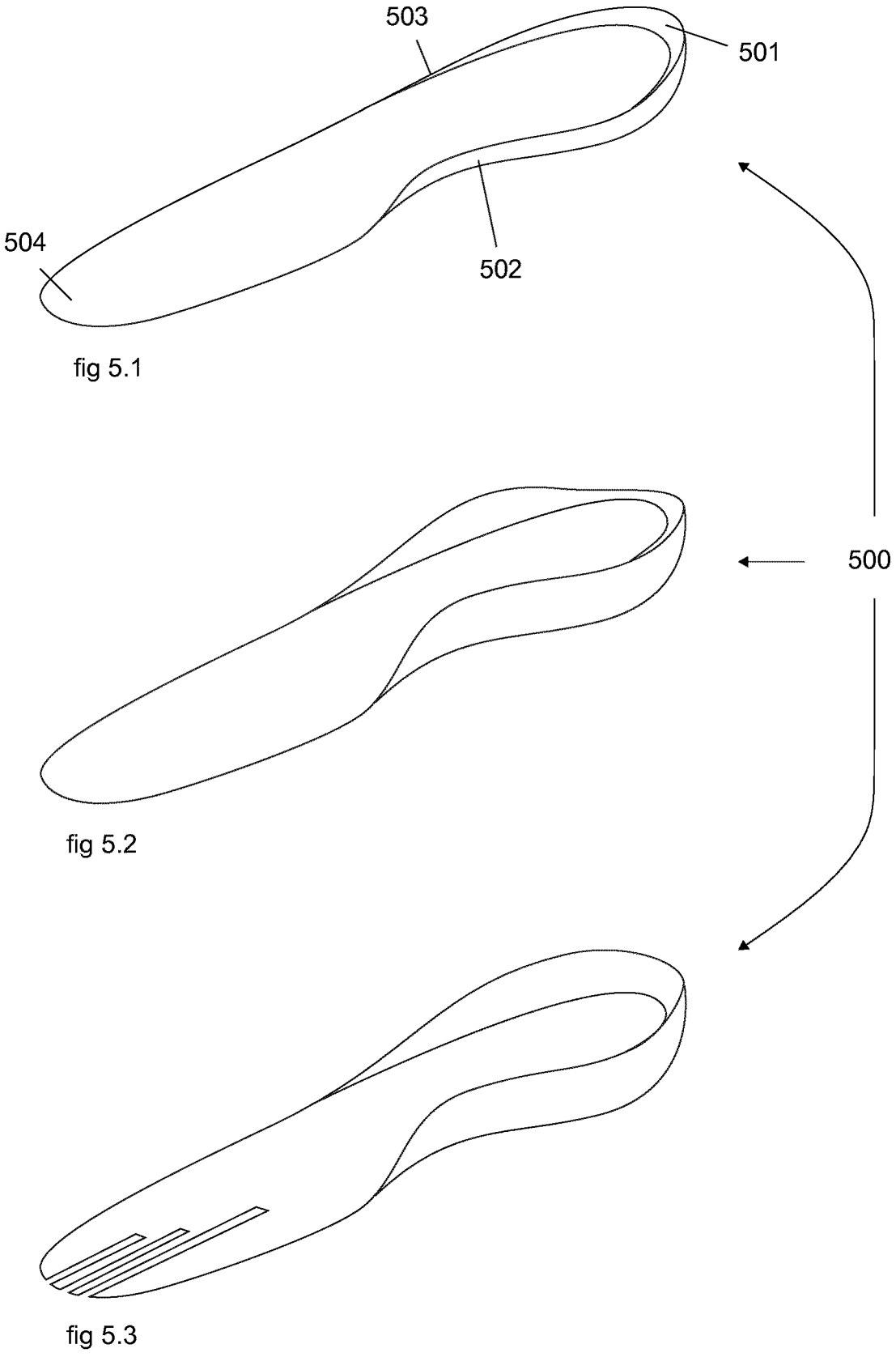
FIG. 5 illustrates different supports in a sole based on a system and a method according to the present invention.

FIG. 5 illustrates three embodiments of a sole (500) constructed according to the present invention, all constructed according to the same initial template data and different user profile data, providing different levels of support in various regions of the shoe, each sole supplying a specified degree of heel support (501), arch support (502), lateral support (503) and forefoot support (504).

FIG. 5.1 depicts a shoe with minimal heel, lateral and arch support. FIG. 5.2 depicts a sole with significant lateral and arch support. FIG. 5.3 depicts a sole with significant heel, arch and lateral support, while having less forefoot support.

Clauses

1. A method for generating control data for controlling a shoe part production machine for making shoes or elements for influencing the properties of the shoe, such as inlays or modules to be mounted on the sole, said system comprising:
   - receiving user profile data describing the characteristics of the user,
   - receiving a user selection identifying a selected shoe from a number of shoe models or a selected element influencing the property of a shoe,
   - generating modified template data by modifying a shoe sole template corresponding to the selected shoe model or by modifying an element influencing the properties corresponding to the selected element, said modifications being performed based on said received user profile data,
   - generating control data based on said modified template data.

2. A method according to clause 1, wherein said template data stored in said storage means is linked to a predefined number of possible modified templates and one of said modified templates being selected based on said modified template data.

3. A method according to clauses 1-2, wherein said user profile data comprises use data and test data.

4. A method according to clause 3, wherein at least some of said user data describes the shoe usage pattern of the user, which has been automatically stored and collected by a data collection unit positioned in the shoe.

5. A method according to clauses 3-4, wherein at least some of said user data comprises data obtained by questioning the user.

6. A method according to clauses 3-5, wherein at least some of said test data is obtained by testing the user, e.g. in a walking machine or a foot pattern measurement device.

7. A method according to clauses 1-6, wherein a shoe sole template to be modified describes a shoe sole having cleats and wherein at least the positioning and/or design of said cleats are modified according to said user profile data.

8. A method according to clauses 1-7, wherein a shoe sole template to be modified describes a shoe sole having integrated support areas and wherein at least the positioning and/or design of said support areas is modified according to said user profile data.

9. A method according to clauses 1-8, wherein an element for influencing the properties of a shoe is a cleat element to be attached to a shoe sole surface and wherein at least the positioning and/or design of said cleats on said cleat element is modified according to said user profile data.

10. A method according to clauses 1-9, wherein an element for influencing the properties of a shoe is a support element to be poisoned inside the shoe and wherein at least the design of said support element is modified according to said user profile data.

11. A method according to clauses 1-10, wherein generating modified template data is based on a combination of said user profile data and pre-collected use data to improve the calculation algorithms of said system for situations where substantially only test data is available.

12. A system for generating control data for controlling a shoe part production machine for making shoes or elements for influencing the properties of the shoe, such as inlays or modules to be mounted on the sole, said system comprising:

input means for receiving user profile data describing characteristics of the user, input means for receiving a user selection identifying a selected shoe from a number of shoe models or elements influencing the property of a shoe, storage means storing template data, said template data either describing shoe soles relating to each of said shoe models or said template data describing other elements influencing the properties of the shoe, a processing unit for generating modified template data by modifying a shoe sole template corresponding to the selected shoe model or by modifying an element influencing the properties corresponding to the selected element, said modifications being performed based on said received user profile data, a processing unit for generating control data based on said modified template data.

13. A system according to clause 12, wherein said template data stored in said storage means are linked to a predefined number of possible modified templates and one of said modified templates is selected based on said modified template data.

14. A system according to any of the clauses 13-14, wherein said user profile data comprises use data and test data.

The invention claimed is:

1. A method for making shoes having optimized traction properties by customizing modules to be mounted on the sole for a specific user, said method comprising the steps of:

receiving, at a processing unit, user profile data describing characteristics of the specific user, wherein the user profile data comprises use data and test data, the use data being collected from measurements performed by a sensor unit in a heel area of a test shoe;

receiving, at the processing unit, a user selection identifying a selected shoe from one or more shoe models, each of the one or more shoe models being associated with a template;

generating, by the processing unit, modified template data, based on the user profile data, by modifying the template;

generating, by the processing unit, control data based on said modified template data;

transmitting the control data to a shoe part production machine configured to produce a shoe; and manufacturing, by the shoe part production machine, the selected shoe based on the generated control data and having traction properties based on the use data and the test data.

2. A method according to claim 1, wherein said modified template data is stored in a data storage and is linked to a predefined number of possible modified templates, one of said modified templates being selected based on said modified template data.

3. A method according to claim 1, wherein said user data comprises data relating to actual use of shoes by the user.

4. A method according to claim 1, wherein at least some of said user data describes a shoe usage pattern of the user, the shoe usage pattern of the user having been automatically stored and collected by a data collection unit positioned in the test shoe.

5. A method according to claim 1, wherein the user data comprises measurements from at least two different types of measurement data, and the measurements are compared to identify a data collection period for identifying modification data.

6. A method according to claim 5, wherein the measurements are acceleration measurements and pressure measurements.

7. A method according to claim 6, wherein the acceleration measurements are collected in at least one dimension that is substantially parallel to a ground contacting surface of the shoe.

8. A method according to claim 6, wherein the pressure measurements are collected in a dimension that is at an angle to the ground contacting surface of the test shoe.

9. A method according to claim 1, wherein a shoe sole template to be modified describes a shoe sole having cleats and wherein at least the positioning of said cleats is modified according to said user profile data.

10. A method according to claim 1, wherein a shoe sole template to be modified describes a shoe sole having integrated support areas and wherein at least the positioning of said support areas is modified according to said user profile data.

11. A method according to claim 1, wherein generating modified template data is based on a combination of said user profile data and pre-collected use data to improve calculation algorithms of said system for situations where substantially only test data is available.

12. A method according to claim 1, wherein a shoe sole template to be modified describes a shoe sole having one or more cleats and wherein at least the design of said one or more cleats is modified according to said user profile data.

13. A method according to claim 1, wherein a shoe sole template to be modified describes a shoe sole having one or more cleats and wherein at least the positioning and design of said one or more cleats are modified according to said user profile data.

14. A method according to claim 1, wherein a shoe sole template to be modified describes a shoe sole having integrated support areas and wherein at least the design of said support areas is modified according to said user profile data.

15. A method according to claim 1, wherein a shoe sole template to be modified describes a shoe sole having integrated support areas and wherein at least the positioning and design of said support areas are modified according to said user profile data.

16. A system for generating control data for controlling a shoe part production machine for making shoes having optimized traction properties by influencing properties of modules to be mounted on a shoe sole for a specific user, said system comprising:

a first receiver for receiving user profile data describing characteristics of the user, wherein the user profile data comprises use data and test data, the use data being collected from measurement performed in a heel area of a test shoe;

a second receiver for receiving a user selection identifying a selected shoe from one or more shoe models;

data storage for storing template data, said template data describing shoe soles relating to each of said shoe models;

a processing unit for generating modified template data by modifying a shoe sole template corresponding to the selected shoe model, said modifications being performed based on said received user profile data, wherein the modifications comprise traction properties based on the use data and the test data; and a processing unit for generating control data based on said modified template data.

17. A method for making elements for optimizing traction properties of a shoe by customizing modules to be mounted on the sole for a specific user, said method comprising the steps of:

receiving, at a processing unit, user profile data describing characteristics of the specific user, wherein the user profile data comprises use data and test data, the use data being collected from measurements performed by a sensor unit in a heel area of a test shoe;

receiving, at the processing unit, a user selection identifying a selected element influencing the property of a shoe, each of the selected elements being associated with a template;

generating, by the processing unit, modified template data, based on the user profile data, by modifying the template;

generating, by the processing unit, control data based on said modified template data;

transmitting the control data to a shoe part production machine configured to produce a shoe; and manufacturing, by the shoe part production machine, a shoe having the selected element based on the generated control data.

18. The method of claim 17, wherein an element for influencing the properties of a shoe is a cleat element to be attached to a shoe sole surface and wherein at least the positioning of said cleats on said cleat element is modified according to said user profile data.

19. The method of claim 17, wherein an element for influencing properties of a shoe is a cleat element to be attached to a shoe sole surface and wherein at least the design of one or more cleats on said cleat element is modified according to said user profile data.

20. The method of claim 17, wherein an element for influencing properties of a shoe is a cleat element to be attached to a shoe sole surface and wherein at least the positioning and design of one or more cleats on said cleat element are modified according to said user profile data.

* * * * *